United States Patent [19]

Jerabek

[11] 4,408,393

[45] Oct. 11, 1983

[54] CHAIN SAW

[76] Inventor: Bohumil Jerabek, Jerabek & Associates Ltd., Research & Testing Laboratories, POB 8566, Ottawa, Ontario, Canada, K1G 3H9

[21] Appl. No.: 246,433

[22] Filed: Mar. 23, 1981

Related U.S. Application Data

[63] Continuation-in-part of Ser. No. 69,211, Aug. 23, 1979, abandoned.

[30] Foreign Application Priority Data

Jun. 8, 1979 [CA] Canada ..... 329343

[51] Int. Cl.[3] ..... B27B 17/02; B27B 17/12

[52] U.S. Cl. ..... 30/123.4; 30/383; 83/833; 83/834

[58] Field of Search ..... 30/123.4, 381–387; 83/820–821, 830–834; 299/82

[56] References Cited

U.S. PATENT DOCUMENTS

| | | | |
|---|---|---|---|
| 1,016,664 | 2/1912 | Bailey | 30/384 |
| 1,397,026 | 11/1921 | Wolf | 83/832 |
| 2,197,210 | 4/1940 | Forrest | 83/832 |
| 2,924,110 | 2/1960 | Gudmundsen | 30/383 |
| 3,283,789 | 11/1966 | Silvon | 83/834 |
| 3,469,610 | 9/1969 | Silvon | 83/831 |
| 3,542,096 | 11/1970 | Oehrli | 83/830 |
| 3,545,508 | 12/1970 | Tupper | 83/833 |
| 3,581,783 | 6/1971 | Sandin | 80/123.4 |
| 3,840,991 | 10/1974 | Arff et al. | 30/383 |
| 3,929,049 | 12/1975 | Graversen | 83/833 |

FOREIGN PATENT DOCUMENTS

| | | | |
|---|---|---|---|
| 726424 | 3/1952 | France | 30/386 |
| 990400 | 4/1965 | United Kingdom | 30/384 |

*Primary Examiner*—James G. Smith
*Assistant Examiner*—K. Bradford Adolphson

[57] ABSTRACT

A cutting attachment for a chain saw which substantially reduces the problems of kickback, lubrication and maintenance, is described. The attachment comprises a guide bar, a saw chain and a drive sprocket. The guide bar is smoothly and symmetrically convexly curved along both its longitudinal edges with a first radius of curvature and is provided with a nose portion with a second and smaller radius of curvature. The edge of each of the cutter and balancing links in contact with the bar is provided with two curved surfaces, one surface having a radius of curvature corresponding to the radius of curvature of the nose portion of the bar, and the other surface having a radius of curvature corresponding to the radius of curvature of the longitudinal edge of the bar. The height of the cutter links is chosen in relation to the length of the cutter to prevent rearing of the cutter links. The depth of the groove in the bar is made equal to the depth of the drive links, to provide a zero clearance between the bottom of the groove and the lowest point of the drive links. The chain oil hole is positioned in the bottom groove and sloped to inject oil in the direction of chain motion. The size of the oil hole is reduced to prevent clogging during cutting and to inject oil directly onto the chain links.

8 Claims, 16 Drawing Figures

CHAIN SAW

CROSS REFERENCE TO RELATED APPLICATION

This is a continuation in part of application Ser. No. 069,211 filed Aug. 23, 1979, now abandoned.

FIELD OF THE INVENTION

This invention relates to chain saws and more particularly to a new and improved cutting attachment for use therewith.

BACKGROUND OF THE INVENTION

Conventional chain saws are equipped with a guide bar having a rounded nose portion at its outer end. The nose portion may be provided with an idler sprocket, or roller nose or the chain may run on a sprocketless but generally hardened nose portion. A groove extends along the edge of the bar, and drive links of the saw chain run in the groove. The conventional saw chain itself consists of centered drive links pivotally joined by rivets to cutter links, balancing links and tie links, with cutter links positioned alternatively on opposite sides of the chain. A balancing link, wich may be identical with the tie links is positioned opposite each cutter link. The drive links run in the groove in the guide bar, and in turn are driven by a sprocket or ring mounted on the power take off shaft of a gasoline engine, or other power unit. In order to reduce the overall weight of the chain saw, two stroke engines operating at speeds up to fourteen thousand (14,000) RPM are used to drive the chain. A centrifugal clutch is conventionally included in the saw to disengage the drive to the chain below a predetermined speed, so that the saw when idling has a stationary chain. The chain is generally intended to be run at a lineal speed of 3000 to 4000 feed per minute, and with approximately eight cutters per foot, each designed to cut approximately 25 thousands of an inch deep. Thus extremely high cutting rates are obtained with a light weight portable tool.

In normal use, cuts are made with a chain saw by placing the lower edge of the guide bar on the material to be cut, and as the chain travels around the bar, each tooth contacts the material and removes a chip or chips with each pass through the saw kerf. The shape and size of the chips is dependent on many factors including the shape of the cutter, the height of the depth gauge, the grain of the material, and many other factors.

Other types of cuts may also be made with a chain saw. Frequently during limbing of a felled tree, the upper edge of the guide bar is applied from beneath a limb and the guide bar is urged upwardly to sever the limb. Boring cuts are also made by pressing the nose of the guide bar against the material being cut.

It will be appreciated that the speed and power of a modern light weight chain saw, also creates a potential hazard due to accidental or careless operation of this tool. What is not widely recognized either by chain saw manufacturers or users, is that seemingly small differences in the design of the cutting attachment can turn a tool referred to as a "motorized widowmaker" into a safe, dependable, implement.

Aside from careless handling, which can always be fatal, the next greatest hazard is "kickback".

A kickback is a phenomena which occurs when a cutter of the chain rounding the nose of the bar strikes an object and the momentum of the chain is converted into a force, creating a couple around the handle of the chain saw, causing the chain saw to rotate instead of the chain to translate. This is analogous to the type of couple created when a load is hitched too high on a farm tractor, causing the tractor to overturn backward on top of its driver, instead of drawing the load.

Kickbacks can occur during limbing, buried nose cutting and boring operations, and result too frequenlty in the moving saw chain coming in contact with the head or upper body of the operator. Grievous wounds are caused which are frequently fatal, and if not, require sophisticated surgical intervention. Plastic surgeons are generally required to repair such wounds.

The present invention is directed to the improvement in the safety, versatility and efficiency of cutting attachments for chain saws. These improvements overcome the defects of known prior art cutting attachments both in cutting efficiency, versatility, safety, and from the users standpoint, longevity, both of himself and his machine.

The chain saw industry has devoted much time and effort to solve the problem of kickbacks. One such attempt is the chain brake. This is a device which is intended to stop the chain if a kickback occurs, and hopefully before the chain strikes the operator. Chain brakes do not work! Bloodless corpses have been found in the woods beside an idling chain saw, and the chain brake was on!

Other attempts to solve the kickback problem have included sprocket guide bar noses, specially shaped depth gauges, safety links, asymmetrical guide bars, the so called "banana bar," and others. Possibly the greatest prior art step in the right direction is the work of Curtis L. Graverson of Milwakie, Ore., the inventor of the low profile saw chain, for which he was granted U.S. Pat. No. 3,929,049 on Dec. 30, 1975. Graverson was concerned with the problem of kickback as may be seen for example at column 2 line 17 et seq of the above patent.

Because of the risk of kickback, boring operations are difficult and hazardous. It has been found that the portion of the saw chain entering the cut, during boring operations, becomes slack and the cutters tend to tilt upwardly on the guide bar, resulting in excessive cut and vibration. "Lifting" of the chain off the bar as it is carried around the nose by means of an idler sprocket imposes severe wedging loads on both the drive links and the rivets, stretching and loosening the chain, while lowering of the chain back on to the bar, after passing around the nose, causes hammering, impactation, wear, and vibration. Further, the cutters are poorly supported in a rlatively unstable condition when the chain is lifted clear of the bar as contact is only made via the sprocket teeth inserted between two pivoting rivets and the unbalanced drive links in the groove of the bar.

The contact with the drive links is generally unbalanced because of the sawdust cleaning feature provided therein, and these factors further contribute to the hazardous kickback condition. Furthermore, the idler sprocket teeth tend to jam the chain with wood chips propelled to it by the chip cleaning device on the drive link. This forces the operator to work with a loose chain.

Secondary (grease gun) lubrication of the sprocket at the nose portion of the bar is relatively difficult and further contributes to the wear problem. It should be appreciated that uninterrupted and effective lubrication of the saw chain as it slides around the guide bar is by far the major contributor to control chain wear and kickback.

OBJECTS OF THE INVENTION

It is an object of the present invention to provide a cutting attachment which substantially reduces the risk of kickback, and which has a substantially increased life.

It is also an object of the invention to improve the lubrication of the saw chain and guide bar to decrease wear and improve operation.

It is a further object of the invention to improve the cutting efficiency and versatility of a chain saw by controlling the flow of chips from the saw chain, and preventing chips from re-entering the kerf entrained in the chain, and to keep the guide bar groove and interstices of the chain from becoming clogged with power robbing build up of chips absorbing oil.

It is a further object of the invention to provide a cutting attachment which requires less frequent maintenance.

SUMMARY OF THE INVENTION

These and other objects of this invention are achieved by providing a cutting attachment for a chain saw, said attachment comprising a saw chain, a guide bar and a drive sprocket. The guide bar is provided with a generally elongated symmetrical shape; both long edges are curved outwardly away from each other, and have a relatively large radius of curvature, as defined hereinafter. The nose of the guide bar has a relatively small radius of curvature as discussed below. The groove in the guide bar is of substantially the same depth as the depth to which the drive links extend below the edges of the guide bar. An oil injection hole is positioned in the bottom of the groove and connects to an oil passage which is directed in the direction of travel of the chain. The chain is a chisel or semi-chisel low profile type chain, having an equal number of left and right hand cutters, and with the lower edge of each link modified to run continuously against the rails of the guide bar. The drive sprocket and the guide bar are adapted to be mounted on the chain saw powerhead so that the chain passes around the drive sprocket on a path complimentary to the path around the nose of the guide bar. Whether the drive sprocket is of large or small diameter, it is essential that the top of each tooth of the sprocket have the same radius of curvature as the guide bar nose. That is, the top of each sprocket tooth is a circular segment of the same radius as the nose.

The radius of curvature of the guide bar upper and lower edges (rails) is chosen so that at the design operating linear velocity of the chain, the curved path of the chain causes the centrifugal force exerted on the chain, the oil entrained with the chain, and the cuttings to be such that the guide bar is continuously lubricated, and the groove in the bar is also maintained free of cuttings.

The radius of curvature of the guide bar nose, and correspondingly the drive sprocket tooth top radius is chosen to ensure that for the pitch of the chain, that not more than one cutter is at any time within an arc of approximately 70° on either side of the longitudinal axis of symmetry of the guide bar. This is achieved when the nose radius is approximately twice the chain pitch. The minimum practical pitch is $\frac{3}{8}$ in.

The lower edges of the cutter links and the balancing links are provided with a pair of curved surfaces. The first curved surface extends from end to end of the link and has a curvature not less than the curvature of the upper and lower edges of the guide bar. The second curved surface is centrally positioned on the link and interrupts the first curved surface. The curvature of the second curved surface is choosen to match the curvature of the guide bar nose. On the tie links, only the second curved surface is provided. Thus the links of the chain maintain a maximum effective surface-to-surface contact with the rails of the guide bar. Because of this the temperature of the chain, which normally runs much higher than the bar, is held similar to the bar temperature, since a high rate of heat transfer from the chain to the bar is obtained. Because the chain and bar are at closely similar temperatures the chain does not tend to elongate and sag during use.

The cutter links of the chain are preferably so proportioned that the height of the cutting edge above the lower edge of the link is not more than approximately 50% of the distance between the ends of the cutter link.

DESCRIPTION OF THE DRAWINGS

The invention will be described in more detail hereinafter with reference to the accompanying drawings in which.

DETAILED DESCRIPTION OF THE DRAWINGS

Figure 1:
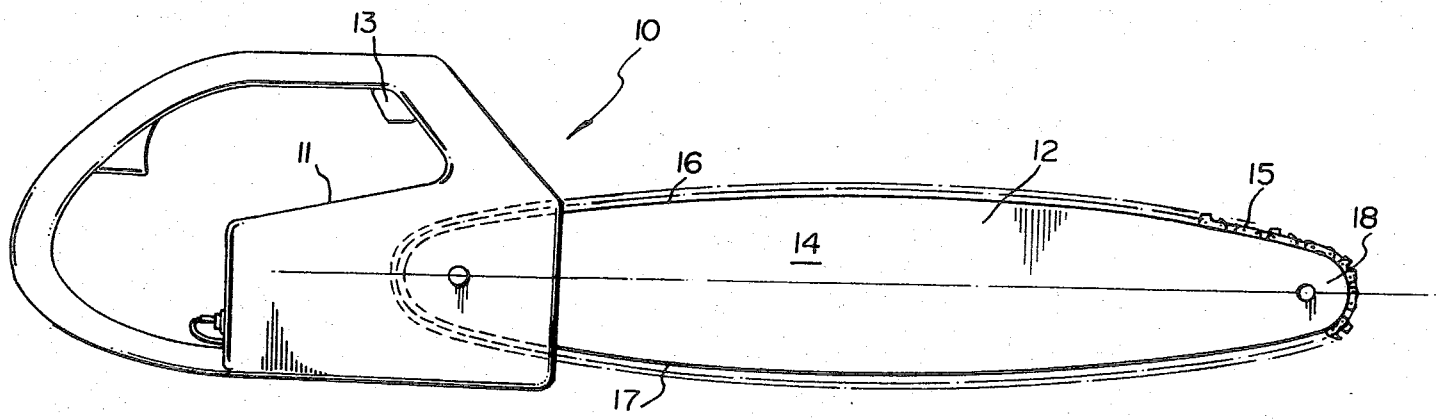
FIG. 1 is a side elevation of a chain saw carrying a cutting attachment in accordance with the present invention.

Referring to FIG. 1 of the drawings, there is shown a chain saw 10 consisting of a power head 11 and a cutting attachment 12. Conventionally the power head 11 is provided with a control throttle 13 for controlling the speed of the motor which is normally a two stroke gasoline engine. Such engines have the virtue of a large power output for a small size and are relatively light in weight when made of the usual aluminum and magnesium alloys.

The cutting attachment of the present invention as illustrated in FIG. 1 consists of a guide bar 14, a saw chain 15, and a drive sprocket, not shown. In accordance with the present invention, the guide bar 14 has upper and lower edges or rails 16, and 17 symmetrically convexly curved about the longitudinal axis of the bar and with a sharply reduced curvature of the nose portion 18.

Figure 2:
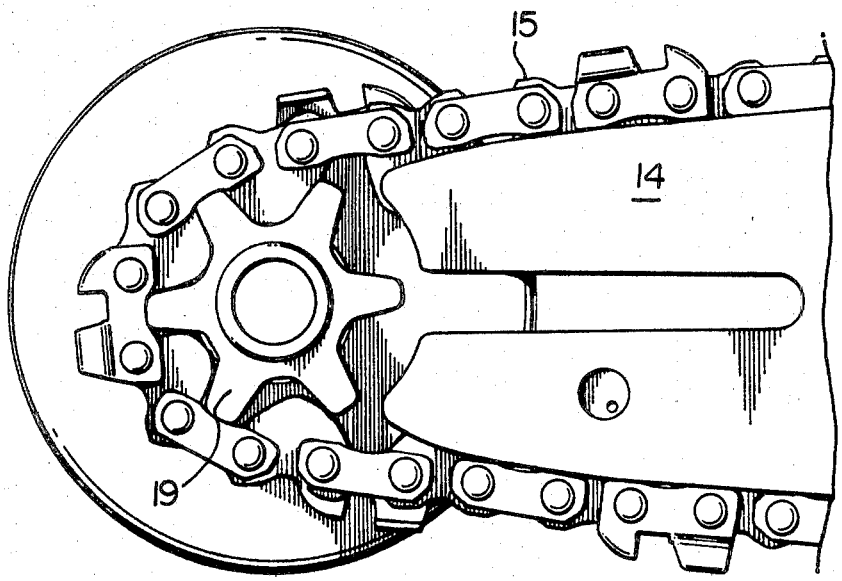
FIG. 2 is a similar view partly broken away of the proximal end of the cutter attachment illustrating the drive sprocket.

As illustrated in FIG. 2, the chain 15 of the cutting attachment is driven by a drive sprocket 19 mounted to the shaft of the power head 11. The power head 11 is also provided with an oil dispensing mechanism, not shown, which consists of an oil reservoir and a pump for supplying oil to the cutting attachment. Details of the oil supply in the cutting attachment will be provided below.

Figure 3:
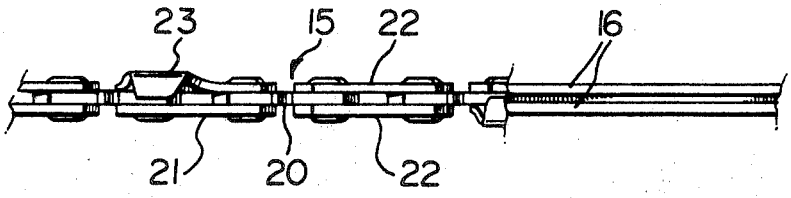
FIG. 3 is a plan view of a portion of chain on the cutter bar in accordance with the present invention.
Figure 4:
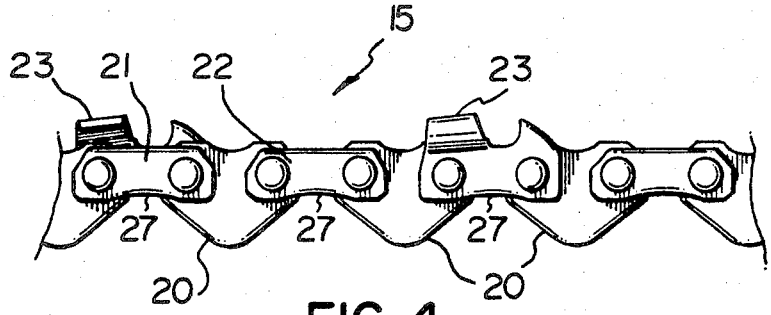
FIG. 4 is a side elevation of the chain of FIG. 3.

FIG. 3 is a plan view of the cutting attachment of FIG. 2 showing the saw chain 15, and showing partly broken away the upper rails of the guide bar 14. As illustrated in FIG. 4 the chain 15 is provided with a series of drive links 20 connected by rivets to tie straps 22 balancing links 21 and cutter links 23. Each of the balancing and tie links 22 and each of the cutter links 23 is provided with a lower surface 27 which is in sliding contact with the guide bar rails. The drive links run in the groove of the guide bar and contact the sprocket 19 to propel the chain. The lower surface 27 of the balancing links 22 and cutter links 23 is specially shaped to conform with the shape of the guide bar as the chain moves around the rails of the guide bar, and will be discussed in more detail in relation to FIGS. 6 and 7 of the drawings.

Referring again to FIG. 4, it should be noted that the upper surfaces of the balancing or tie links 22, may of course by completely flat, or for the sake of manufacturing convenience these links may be so formed that both the upper and lower surfaces of the balancing or tie links are similarly shaped. Also with respect to the drive links, these are shown as having a symmetrical shape, although the prior art drive links such as for example shown in Graverson U.S. Pat. No. 3,929,049 are provided with a notch the function of which is to scoop chips from the slot of the guide bar. There is no necessity for such a notch in the drive link in accordance with the present invention since chips do not tend to collect in the slot.

Figure 5:
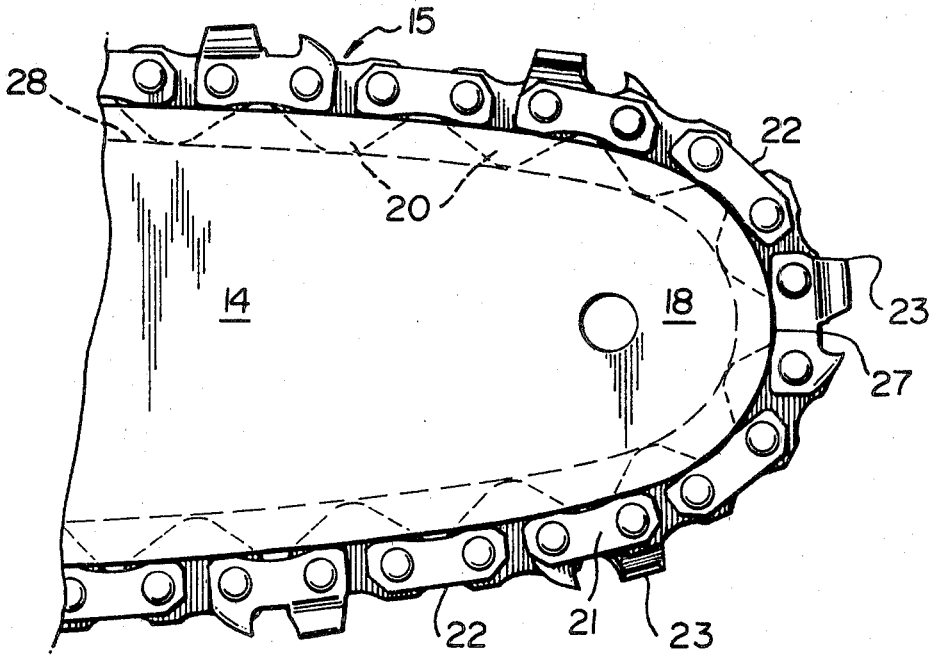
FIG. 5 is a view partly broken away showing the outer end of the cutter attachment of FIG. 1.

Referring to FIG. 5, there is shown a portion of the cutting attachment of the present invention illustrating the nose of the guide bar 18, around which the chain 15 travels. It will be noted that the groove in the guide bar 14 is of a depth corresponding exactly with the depth of the drive links 20 below the upper and lower rails of the guide bar. A significant feature of the invention that may be noted at the nose 18 of the guide bar is that the curvature of the portion 27 of the cutter links, balancing links and tie links conforms exactly to the radius of the nose 18 and that the chain links maintain continuous contact with the rails of the bar 18 as they traverse around the rails of the bar. A second feature of the invention may also be noted in that as illustrated in FIG. 5, there is only one cutter link 23 located at the critical nose portion of the bar 18 at any one time. It should also be noted that because of the shape of the cutter, that is the long curved depth gauge, and the heel, the effective depth of cut of the cutter is substantially reduced as the cutter moves around the nose of the bar. This reduced "bite" of the cutter substantially reduces the reaction force that the chain can generate, and as a result a kickback cannot occur. Moreover, I believe that if not more than one cutter is within a zone of approximately 70° either side of the longitudinal axis of the guide bar at the nose portion at any one time, that the likelihood of uncontrolled kickback is virtually totally removed. This is achieved when the nose radius is approximately twice the chain pitch, and the length of the cutters is approximately 1 and ½ to 2 times height of the cutters above the rails.

Figure 6:
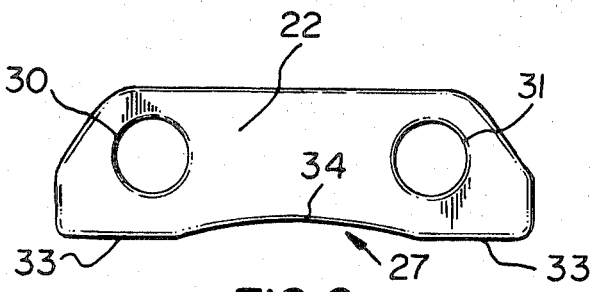
FIG. 6 is a side view of a balancing link, or tie link, constructed in accordance with the invention.
Figure 7:
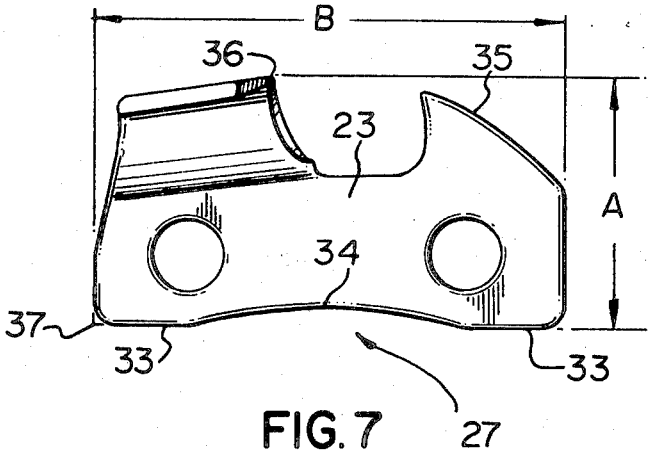
FIG. 7 is a side view of a cutter link in accordance with the present invention.

The critical dimensions of the cutter links of the present invention are more clearly illustrated in FIGS. 6 and 7. FIG. 6 illustrates a balancing link 22 of the invention which has a shape closely resembling the side link of Graverson U.S. Pat. No. 3,929,049, with critical differences. As usual the balancing link 22 is provided with a pair of rivet holes 30 and 31 through which rivets are intended to be inserted in order to connect the side links with the drive links 20 of the chain. This is all in accordance with the well known techniques of the prior art.

In accordance with my invention the lower surface 27 of the balancing link is provided with a pair of surfaces the first being the surface 33 which is interrupted by the surface of higher curvature 34. With reference to FIG. 5 of the drawing, it will be seen that the surfaces 33 maintain intimate contact with the upper and lower rails 16 and 17 of the guide bar 14 and that the surface 34 maintains intimate contact with the rails at the guide bar nose 18 as the link is drawn around the nose 18 during operation. Similarly with the cutter 23, the lower surface 27 is provided with curved surfaces 33 and 34. The cutter 23 of FIG. 7 will also be seen to have the usual configuration of a chisel or semi-chisel cutter, being provided with a depth gauge 35 and a cutting edge 36 which is sharpened in the usual way to maintain the efficiency of cutting. It may be noted that the portion 34 having the radius of curvature corresponding to the nose 18 of the guide bar 16, subtends approximately an angle of 30° to 40°, and it has been found that the minimum angle subtended by the area 34 in both the cutter and in the balancing and tie links should be not less than 30° in order for stable operation of the cutter to occur around the nose of the guide bar. The most critical part of the rail for maintaining lubrication is at the nose. If there is only a small area of link-to-rail contact at the nose, the lubricating film will break down and extreme heating and wear will occur. The nose of the bar will be greatly overheated and annealed, resulting in excessive wear and destruction of the bar. It is thus extremely critical to prevent metal-to-metal contact and heating. Indeed it is more important to provide a longer link to rail contact at the nose than at the any other part of the rails.

It should be noted that as illustrated in FIG. 7 the height of the cutter, Reference A, in relation to the length of the cutter, Reference B, should be in a ratio of approximately 1:1.6, and possibly as great as 1:2. In this regard it has been found by the applicant that the chain disclosed in Graverson U.S. Pat. No. 3,929,049 may be modified, in accordance with the present invention to provide the dimensions specified in relation to FIGS. 6 and 7. In particular, by altering the lower portion of the side links and cutter links of Graverson, to provide the curved surfaces 33 and 34, it is possible to produce a chain which meets the requirements of the present invention. This modified chain possesses vastly superior properties when combined with the guide bar of the present invention to provide a cutting attachment which overcomes all of the problems associated with prior art devices.

Figure 8:
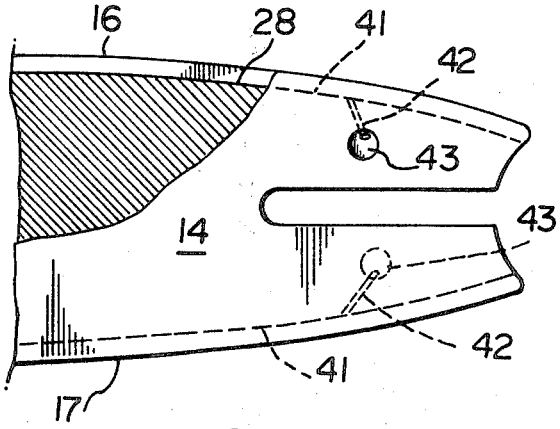
FIG. 8 is a side view partly broken away illustrating the construction of the guide bar of the present invention.

FIG. 8 illustrates a segment of the guide bar 14 of the present invention constructed in accordance with the applicant's teachings. In particular, the bar consists of the usual upper and lower rails 16 and 17, the bar being symmetrical about its longitudinal axis. As will be apparent to those skilled in the art, one of the virtues of having a symmetrical bar is that it may be mounted to the saw with either edge upward, and provided appropriate oiling connections are made to the power head of the saw, adequate oiling of the chain will occur. In this regard, the present invention provides a novel and improved oil system for the guide bar of a chain saw cutting attachment which substantially improves the operation of the chain saw, thereby significantly reducing wear on the components, the generation of heat during operation particularly in the critical nose portion of the guide bar, and thereby improving the longevity of the chain, and other benefits as noted above.

One might wonder what relevance there is in the way a chain is lubricated as it travels around the guide bar to the problems of cutting efficiency and kickback. Everyone appreciates the necessity for oiling a chain. Up to now however, no one has appreciated the possibility of maintaining continuous, positive lubrication around the entire guide bar, and the benefits of being able to run the chain in continuous sliding contact with the bar. Unless the chain/bar interface is continuously separated by a layer of lubricant overheating and annealing of the chain and bar occurs. To avoid this, it is common to run the chain with slack in it, and to file down the depth gauges to achieve a satisfactory cutting rate. This is a very dangerous practice, since it greatly increases the chance of a kickback occurring.

In the absence of continuous positive lubrication, the chain temperature rises faster and to a higher temperature than the bar. Therefore the chain will expand more rapidly than the bar, causing slack in the chain, and permitting the cutters to rear up, or tilt around the nose of the bar, causing a kickback.

I have discovered that the chain can be run in sliding contact with the rails of the guide bar, even around the nose, by following the procedures set out below. The edge of the guide bar 14 is provided with a groove 28 in which the drive links 20 of the chain 15 slide. In accordance with the invention the depth of the groove 28 is made to correspond exactly with the depth of the drive links 20 so that there is a zero clearance between the bottoms of the drive links 20 and the bottom 41 of the groove 28. By ensuring that there is zero clearance between the bottom of the drive links 20 and the bottom of the groove 41, the applicant ensures that all oil which enters the groove 28 is propelled around the slot by the drive links 20. In accordance with a further feature of the invention, the oil from the chain saw is injected into the groove 28 through a passageway 42 which terminates at the bottom 41 of the groove 28. The passageway 42 communicates between the bottom 41 of the groove 28 and a small blind hole 43 bored into one face of the guide bar 14, but not completly through the bar. Thus by providing a blind hole 43, with the passage 42 communicating therebetween and the bottom surface 41 of the guide bar groove 40, oil is directly injected in a jet through the passageway 42 into the groove 28. Because the passage 42 is the same diameter as the width of the groove, for example approximately fifty-thousandths of an inch, and because the passageway 42 is angled in the direction of motion of the chain, the oiling passages will not become clogged with debris from the saw but will remain clear at all times and oil will be continuously and immediately delivered to the chain during operation.

Dismantling of the cutting attachment from the powerhead to clean the groove and oil hole is permanently eliminated. This cleaning procedure is insisted on by all chainsaw manufacturers, but never practised by the chainsaw user. The importance of adequately oiling the chain cannot be over-emphasized, since without proper lubrication, the chain cannot cut properly, nor can it be prevented from binding and overheating the guide bar causing premature breakdown of heat-treated surfaces and destruction of the cutting attachment.

In accordance with one aspect of my invention, I have found that the guide bar which has a groove deeper than required to provide adequate clearance for the drive links of the chain, may be made suitable for operation by filling the groove of the guide bar with an aluminum filled epoxy, which while still in the liquid stage, can be removed to a depth corresponding to the depth of the drive links. Indeed if the depth of the epoxy layer is too great, such that the groove is too shallow, the drive links will quickly abraid the aluminum filled epoxy to provide a precise zero clearance fit for the drive links in the bottom of the groove. By this means, the lubrication of the chain is greatly enhanced and the optimum zero clearance depth of the groove is permanently maintained throughout the life of the guide bar.

Figure 9:
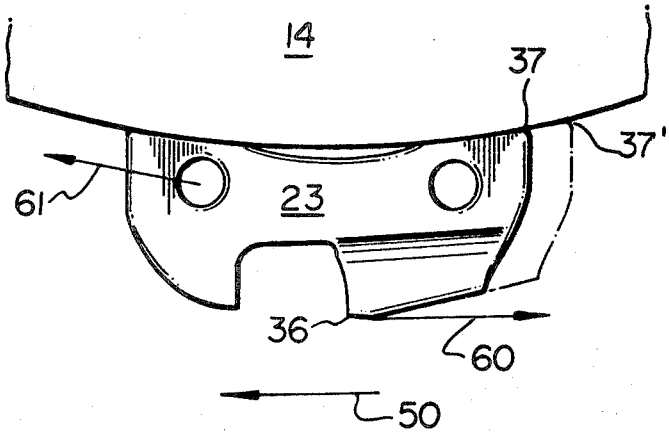
FIG. 9 is a view illustrating schematically the forces operating on a cutter on the long edge of the guide bar.

FIG. 9 is a magnified drawing illustrating a single cutter 23 as it travels on a guide bar 14. It will be appreciated that the cutter 23 is moving in the direction of the arrow 50, and that the cutting edge 36 will thus come in contact with the material to be cut, creating a force illustrated by the arrow 60 in the direction opposite to the direction of motion 50. This force 60 creates a couple around the point 37 of the cutter 23 which is in contact with the guide bar 14 which couple seeks to cause rotation about the point 37. This couple is resisted by the downward force 61 drawing the chain in the direction of the arrow 50. The force 61 creates a couple acting in the opposite direction to the force 60. The closer the point 36 to the guide bar 14, in relation to the distance between the point 36 and the point 37, the lower the couple will be tending to cause rotation of the cutter 23 about the point 37. Indeed in accordance with the invention, if the shape of the tooth is modified, to extend the cutter substantially to the rear, in the direction of travel, such as illustrated in 37' of FIG. 9, substantial improvements can be obtained in the longevity of the chain, and in the resistance of the cutters to lifting during cutting operation. I consider that lifting of the cutters about the point 37 during operation is one of the major problems which gives rise to kickbacks, and as well causes damage and premature wear to the guide bar 14 due to rocker-like cutter surface and small effective contact area which is unable to retain lubricant between the heel and rails of the guide bar.

Extensive experimentation and testing has established that kickback in chain saws is largely a function of contact between the bar and the chain as its passes over the critical nose area of the bar, particularly in boring operations. As pointed out hereinabove, wedging loads on the chain as it passes over a sprocket guide bar nose causes elongation wear and wear of the chain rivets and drive link holes. Return of the chain causes hammering and impact wear of the bar rails. Further, while the chain is "lifted" away from the bar it is unstable since it is dependent for its stability solely on the depending drive link flange engaging in the groove in the guide bar. Such engagement can cause considerable side loading on the cutter links and the chain is consequently relatively unstable. The problem is therefore one of designing a saw chain in which all links maintain constant lineal contact with the bar throughout its travel around the bar, including during the critical transition between the longitudinal edge and the nose portion of the bar.

It has been found that elimination of the wedging loads from small diameter sprockets and hammering by maintaining constant lineal contact between the chain and bar has important side effects. Firstly chain oil is more easily carried with the chain around the nose of the bar and a lubrication layer is maintained between the chain and the bar rails at all points. Thus wear and overheating are avoided. Chain jamming with sawdust is eliminated; chain stretching is eliminated; chain and bar noise is reduced and pitch is not altered. Kickback is avoided.

It is of primary importance to the present invention that the chain be carefully and closely matched to the bar with which it is used. Heretofore straight and curved bars have both been proposed. Even asymmetrically curved bars, the so-called "banana bars," have been proposed. Straight bars with corresponding straight edge chain links provide excellent lineal contact during longitudinal travel therealong, but only limited point contact and hence loss of lubrication at the nose of the bar. Further, straight edge guide bars of course have no self-cleaning feature nor do they have the capability of forcing the chain oil to engage the wear surfaces of the chain as does the bar of the present invention. Similarly asymmetrically curved bars cannot provide large area lineal contact. Because of the asymmetry of the bar the effective contact area between bar and chain is extremely small and consequently heat and wear is excessive.

In carrying out the present invention therefore, a symmetrically curved has as set out above is essential.

Curved bars are not new to the art, but heretofore have only been employed with straight sided chain links so that only point contact is achieved on the longitudinal edges and at the nose. Parabolically curved bars have also been used but these vary in curvature along their length.

It has been found essential that the chain length be so selected and the chain so constructed as to have an equal number of cutter links extended left and right so as to neutralize side thrust and consequent wear of the chain drive links and the bar groove sides.

A typical 18-inch bar constructed in accordance with the present invention is provided with a curved nose portion having a radius of curvature of approximately 0.71 inch (36 mm), and a longitudinal curved surface having a radius of curvature of approximately 72 inch (1925 mm). It will of course be appreciated that differently sized bars will have correspondingly different radii of curvature. It is of course conventional in guide bar design to provide hardened inserts at the nose of the bar to assist in resisting wear.

As set forth above, the essential relationship of the curvature of the bar to the saw chain is such that a sufficient centrifugal force will be generated by the chain as it travels along the curved long edges of the bar to ensure that chain oil is constantly present at all sliding and rotating joints of the chain on the guide bar and all chips are expelled outwardly from the chain at the first opportunity. At the same time, the radius of curvature at the nose of the guide bar must also be related to the top plate angle of the cutter and to the depth gauge shape, and the pitch of the chain in such a way that not more than one cutter is within the critical zone of the nose as set forth above at anyone time.

Figure 10:
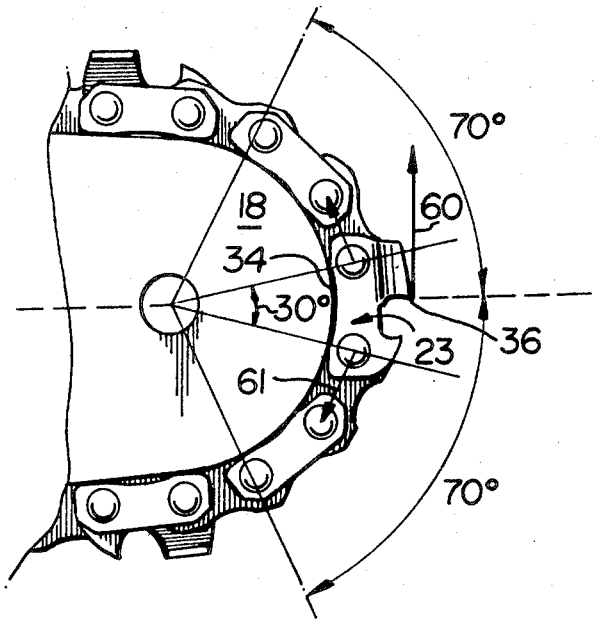
FIG. 10 is a figure similar to FIG. 9 illustrating the forces acting on a cutter link as it is carried around the nose of the guide bar.
Figure 11:
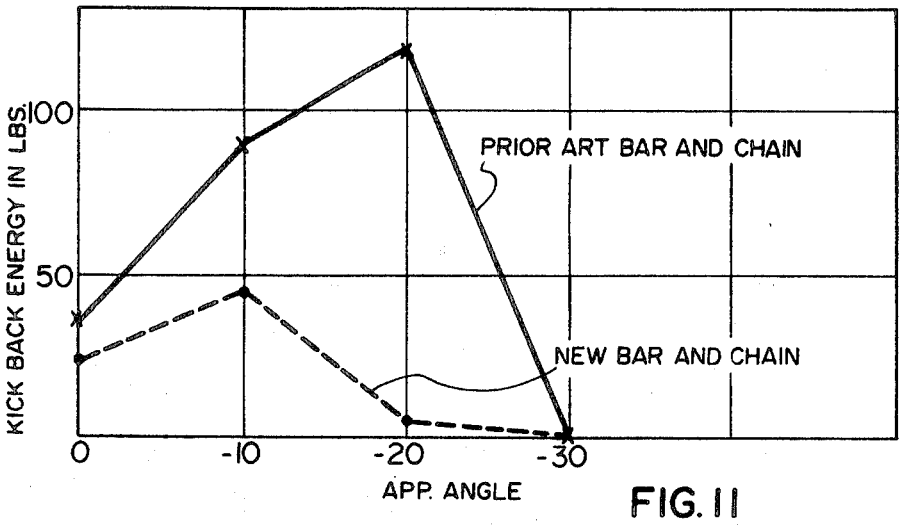
FIG. 11 is a graph illustrating reduction of kickback energy using the cutter attachment of the present invention.
Figure 12:
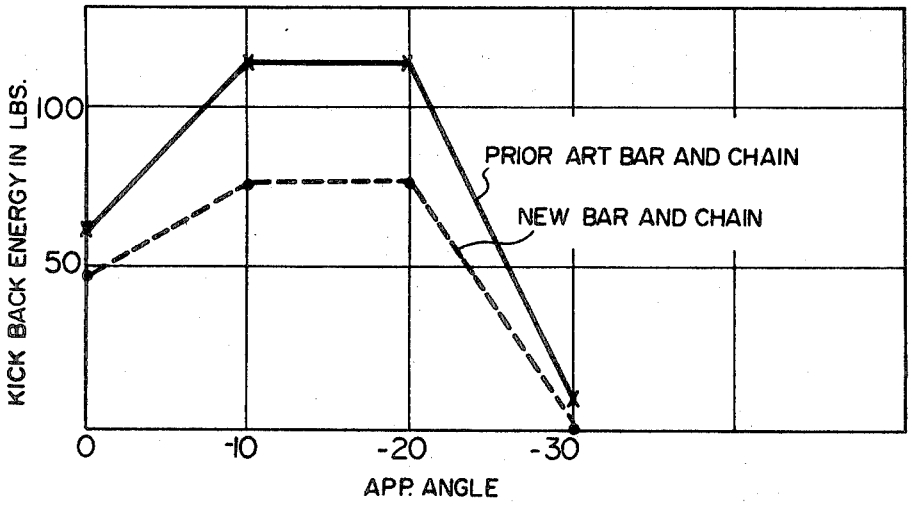
FIG. 12 is a graph similar to FIG. 11 at a higher approach velocity.

FIG. 10 illustrates this important point in more detail. The cutter 23 is shown passing around the nose 18, with the cutting edge 36 in contact with the material to be cut, generating a force 60 as shown. This force which tends to lift the cutter is balanced by the downward component of the force 61 to maintain the curved surfact 34 in contact with the nose 18 it will be noticed that the surface 34 in contact with the nose 18 it will be noticed that the surface 34 sublends an angle of approximately 30° so that a high proportion of the lower surface of the cutter 23 is in contact with the nose, thereby maintaining the lubricant layer between the nose 18 and cutter 23. It may also be noted that only one cutter at a time is in the critical zone of about 70° either side of the long axis of the bar 14.

Figure 13:
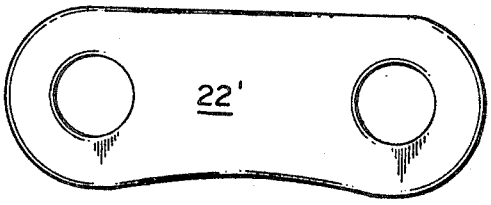
FIG. 13 is a side view of a modified tie strap.
Figure 14:
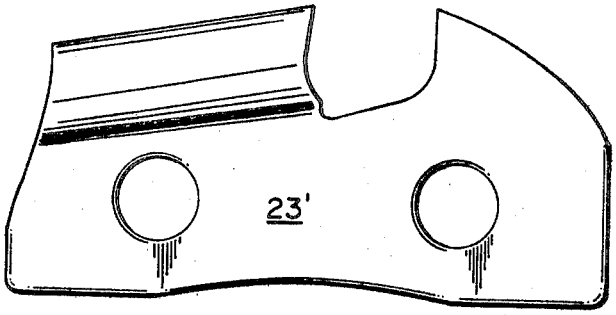
FIG. 14 is a side view of a modified extended cutter of the present invention.
Figure 15:
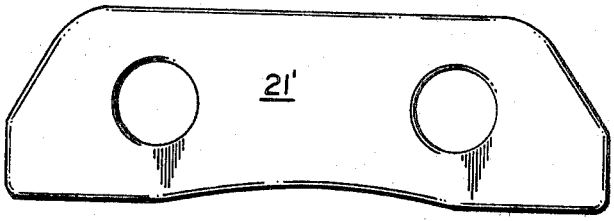
FIG. 15 is a side view of a modified balancing link for the cutter of FIG. 14.

Referring to FIGS. 13 to 15, in one preferred form of chain in accordance with the present invention, the shape of the tie straps 22' may be reduced to a minimum length, for a given pitch of the chain, and the length of the cutter links 23' and their respective balancing links 21' increased correspondingly so as to provide a longer length on the cutter link and hence increased weight and stability thereof to preventing lifting of the cutter link from the bar.

The radius of curvature of the nose portion 18 is a function of the top plate angle and depth gauge shape as discussed above. It will be appreciated that the length of the bar, must be such that there will be an equal number of left and right hand cutters.

The minimum practical pitch of the chain in this concept begins at about 0.375". It is a particularly preferred feature of this invention that the radius of curvature of the nose portion of the bar shall be as small as possible while still permitting the chain to pass smoothly there around without lifting or binding or otherwise hammering or chattering.

In practice the radius of curvature of the nose is identical to the diameter of the drive sprocket but may be varied between $\frac{5}{8}$"–1". It is also preferred that the diameter of the nose portion be equal to the diameter of the drive sprocket at the other end of the bar so that the path travelled by the chain is symmetrical on both edge of the bar.

The size of the drive sprocket is a function of the power of the head driving the chain. Generally a 6 or 7 tooth drive sprocket is employed. Small saws for the casual or domestic user generally have electric motors or gasoline engines with a displacement of 40 cc, or less, which provides sufficient power to drive the chain.

The radius of curvature of the longitudinal surface 16 and 17 of bar 14 is also strictly controlled as discussed above. For bars up to about 19' long, it has been found that the radius of curvature should be about 72" (1925 mm). Note, in the short bar the 1925 mm delivers 2G at clutch engaging speed. The longer bars do not need such high acceleration because the force acts upon the chain oil for a longer time and for bars in excess of this length the radius of curvature should be increased somewhat to perhaps about 96" maximum. A chain designed for use with a 72" radius bar can be used on a bar having a larger radius as it will eventually wear-in to fit from the outside edges inwards, ensuring lineal contact at all times, but the converse does not apply. That is, a chain designed for a 96" radius bar cannot be used on a 72" radius bar. As the links of the chian slide along the guide bar, with a chain which is provided with curvatures 33 (FIGS. 6 and 7) intended for use for example with a bar having a radius on the long edges of 72" on a bar of 96" radius, it will be appreciated that the fore and aft corners of the side links and cutting links will be in contact with the surface of the bar, rather than the inner corners at the junction with the curved surface 34. If, however, a chain intended for use on a bar having a large radius of curvature for the long edges is used on a bar having a smaller radius of curvature, then the cutter teeth will be supported only at the inside corners constituting the junction between the surfaces 33 and 34, and this will permit the cutter links to rock back and forth since they are only supported at an inner point rather than at the extreme end of the cutter link. Thus, wear must take place from the outside in to obtain lineal contact. It is important that the longitudinal curved surfaces 14 and 15 shall be a continous segment of a circle, and not a curved noncircular shape, in order to ensure maximum lineal contact between the links and the bar throughout travel of the chain. This is believed to be a major distinction over the curved bars, or bars not having a constant circular shape. The continuous curve is important in order to ensure chip removal, proper lubrication of the chain during its travel and rapid heat transfer from chain to bar.

The constant radius of curvature of the bar ensures that oil is carried to all parts of the chain by centrifugal force and that wood chips are also removed cleanly by centrifugal force as soon as the chain exits the kerf. If the radius of curvature is too small, for the lineal chain velocity, the lubricating oil is thrown outwardly from the point of introduction and does not lubricate the chain, and if the radius of curvature is too large, then there is insufficient force to throw the oil outwardly to the chain links and insufficient lubrication occurs.

Figure 16:
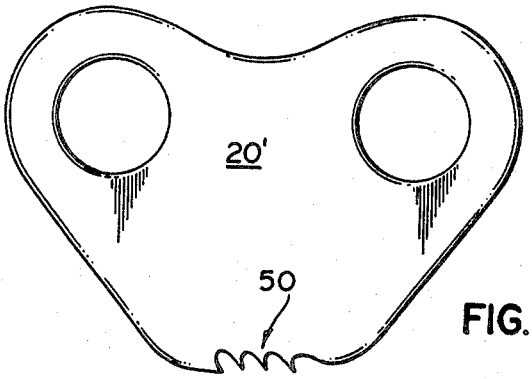
FIG. 16 is a side view of a modified drive link of the present invention.

Prior art guide bars have a groove generally twice the depth of the drive link. This prior art bar coupled with existing lubrication practices prevents the chain oil from reaching the chain until the groove has become saturated with oil. Also, such grooves tend to become filled with chips and sawdust, and due to the shape of the notched drive link, it tends to press the chain oil into the sawdust rather than causing the oil to flow through the chain. It is, therefore, an important aspect of the present invention that oil should be transferred away from the channel 42 immediately upon introduction, thus avoiding the notorious problem of oiling passages blocking and sawdust build-up in the groove. Transfer of oil from the oil feed hole to the chain is facilitated by angular introduction of oil along the oil passage 42 into the groove and by the zero clearance between the drive links and the bottom of the groove. Preferably the oil passage is at an angle between 45° and 90° to the direction of movement of the chain, and more particularly it has been found that an angle of 60° yields superior results. Further, there should be no clearance between the bottom of the groove and the drive links to eliminate oil draining from the chain into the space between drive links and the bottom of the groove during stops between cutting. In order to prevent wear of the drive links on the bottom of the groove, as the bar rails wear, it is preferable that the zero clearance be obtained by partially filling the groove with a relatively soft and easily abraded material, such as an aluminum filled epoxy resin, which will adhere firmly to the walls of the groove and resist chemical reaction with the oil, even at elevated temperatures. It will be appreciated that as the rails and chains wear, the drive links abrade the relatively soft epoxy resin and maintain a zero clearance. FIG. 16 shows a slightly modified form of drive link 20' provided with one or more serrations 50 to assist in abredeing the bottom of the groove operation, to maintain zero clearance. Oil injected through the oil passage is picked up by the drive links and is pressurized by centrifugal force throughout all of the links and rivets as the chain travels along the smoothly curved longitudinal path created by the bar. Oil is also held between the links and the bar during rest periods and wear of the bar is thus substantially eliminated. As oil is carried by the chain itself and is not dependent upon transport along a partially clogged groove to reach the nose of the bar, heating and wear at the nose of the bar is also markedly reduced as the time taken for oil to reach the nose is much reduced. Rapid transport of oil to the nose is, of course, particularly important when the saw is operated under extreme load conditions. 60% of cutter surface is in effective contact with the bar rails at the nose, while 40% on the large radius. The effective heat transfer to the large heat sink of the bar is achieved. At 1:2 ratio this would be 50/50. At low ambient temperatures the somewhat viscous and flows less readily along the channel, resulting in a relatively long delay before oil reaches the tip. At high temperatures, although the oil is relatively fluid, it is easily retained in the large effective contact area which must be maintained for cooling the chain. (The oil conducts the heat to the bar).

In order to demonstrate the advantages of a chain and bar of the present invention relative to a conventional chain and bar a series of comparative kickback tests were conducted using standard chain saw manufacturers' tests in which an operating chain saw is freely suspended about its point of balance over a log carriage track along which a log carriage and log can be propelled at controlled speed, acceleration and at a specified angle to the saw bar. Upon impact with a moving log the chain bits into the log and kicks back or rotates. The angle of rotation is determined as a measurement of the kickback energy of the saw under test.

I do not agree with this test!. While this testing procedure produces some angular velocity, this velocity cannot be duplicated when the same chainsaw is handheld and rammed against the same piece of wood. And that is the reality!. But that's all the industry has.

EXAMPLE 1

A Poineer P28S portable chain saw equipped with a SW16001-DS bar and a 375 Procut chain was tested at 0, 10, 20, and 30 degrees to the perpendicular at impact speeds of about 18 and 28 in/sec, under the influence of acceleration weights of 2 and 5 lbs. respectively, falling over the end of the track, into the end grain of hemlock logs. The results are tabulated below in Table I.

TABLE I

| RUN NO. | ACCEL. WT. (LBS.) | APP. ANGLE (DEG.) | ENGINE RPM AT IMPACT | VELOCITY IN./SEC. AT IMPACT | LINEAR REACTION LIFT HT. (IN.) | LINEAR REACTION NET ENERGY (IN./LB.) | ROTARY REACTION KICK. ANGLE (DEG.) | ROTARY REACTION NEG. FORCE (LBS.) | ROTARY REACTION NET ENERGY (IN./LBS.) | TOTAL NET ENERGY (IN./LB.) |
|---|---|---|---|---|---|---|---|---|---|---|
| 1 | 2 | −20 | 9000 +200 | 19 | 10 | 20 | 201 | 11 | 113.4 | 133.4 |
| 2 | 2 | −20 | 9000 +200 | 19 | 10+ | 20+ | 180 | 11 | 101.5 | 121.5 |
| 3 | 2 | −20 | 9000 +200 | 19 | 10+ | 20+ | 146 | 11 | 82.3 | 102.3 |
| 4 | 4 | −20 | 9000 +200 | 30 | 6 | 24 | 170 | 11 | 95.9 | 119.9 |
| 5 | 4 | −20 | 9000 +200 | 30 | 6⅝ | 265 | 130 | 11 | 73.3 | 99.8 |
| 6 | 4 | −20 | 9000 +200 | 30 | 6 | 24 | 166 | 11 | 93.6 | 117.6 |
| 7 | 2 | −30 | 9000 +200 | 19 | ¼ | .5 | 0 | 11 | 0 | .5 |
| 8 | 2 | −30 | 9000 +200 | 19 | 0 | 0 | 0 | 11 | 0 | 0 |
| 9 | 2 | −30 | 9000 +200 | 19 | ⅛ | .3 | 0 | 11 | 0 | .3 |
| 10 | 4 | −30 | 9000 +200 | 28 | 1¾ | 7 | 5 | 11 | 2.8 | 9.8 |
| 11 | 4 | −30 | 9000 +200 | 28 | 1 | 4 | 2 | 11 | 1.1 | 5.1 |
| 12 | 4 | −30 | 9000 +200 | 28 | 1⅜ | 5.5 | 5 | 11 | 2.8 | 8.3 |
| *13 | 5 | −30 | 9000 +200 | 33 | 7 | 35 | 55 | 11 | 31 | 66 |
| 14 | 5 | −30 | 9000 +200 | 30 | 1¾ | 8.8 | 3 | 11 | 1.7 | 10.5 |
| 15 | 5 | −30 | 9000 +200 | 32 | 1¾ | 8.8 | 3 | 11 | 1.7 | 10.5 |
| 16 | 2 | −10 | 9000 +200 | 18 | 1½ | 3 | 148 | 11 | 83.5 | 86.5 |
| 17 | 2 | −10 | 9000 +200 | 18 | 1 | 2 | 161 | 11 | 90.8 | 92.8 |
| 18 | 2 | −10 | 9000 +200 | 18 | 1½ | 3 | 152 | 11 | 85.7 | 88.7 |
| 19 | 4 | −10 | 9000 +200 | 28 | ½ | 2 | 200 | 11 | 112.8 | 114.8 |
| 20 | 4 | −10 | 9000 +200 | 28 | ⅞ | 3.5 | 192 | 11 | 108.3 | 111.8 |
| 21 | 4 | −10 | 9000 +200 | 28 | ⅞ | 3.5 | 190 | 11 | 107.1 | 110.6 |
| 22 | 4 | 0 | 9000 +200 | 28 | 0 | 0 | 72 | 11 | 40.6 | 40.6 |
| 23 | 4 | 0 | 9000 +200 | 28 | 0 | 0 | 112 | 11 | 63.2 | 63.2 |
| 24 | 4 | 0 | 9000 +200 | 28 | 0 | 0 | 120 | 11 | 67.7 | 67.7 |
| 25 | 2 | 0 | 9000 +200 | 18 | 0 | 0 | 65 | 11 | 36.7 | 36.7 |
| 26 | 2 | 0 | 9000 +200 | 18 | 0 | 0 | 70 | 11 | 39.5 | 39.5 |
| 27 | 2 | 0 | 9000 +200 | 18 | 0 | 0 | 58 | 11 | 32.7 | 32.7 |

EXAMPLE 2

The procedure of Example 1 was repeated using a Pioneer P28S portable chain saw equipped with an 18" bar modified in accordance with the present invention to have symmetrical longitudinal convexly curved surfaces having a radius of 72" and a Stellite hardened nose portion having a radius of 71" and an Oregon 91S low profile semi-chisel ⅜" pitch chain modified in accordance with the present invention to fit precisely on the modified bar described herein. The results of this series of tests is tabulated below in Table II.

TABLE II

| RUN NO. | ACCEL. WT. (LBS.) | APP. ANGLE (DEG.) | ENGINE RPM AT IMPACT | VELOCITY IN./SEC. AT IMPACT | LINEAR REACTION LIFT HT. (IN.) | LINEAR REACTION NET ENERGY (IN./LB.) | ROTARY REACTION KICK. ANGLE (DEG.) | ROTARY REACTION NEG. FORCE (LBS.) | ROTARY REACTION NET ENERGY (IN./LBS.) | TOTAL NET ENERGY (IN./LB.) |
|---|---|---|---|---|---|---|---|---|---|---|
| 1 | 2 | 0 | 9000 +200 | 18 | 0 | 0 | 72 | 6 | 22.2 | 22.2 |
| 2 | 2 | 0 | 9000 +200 | 18 | 0 | 0 | 80 | 6 | 24.6 | 24.6 |
| 3 | 2 | 0 | 9000 +200 | 18 | 0 | 0 | 73 | 6 | 22.5 | 22.5 |
| 4 | 4 | 0 | 9000 | 28 | 0 | 0 | 155 | 6 | 47.7 | 47.7 |

TABLE II-continued

| RUN NO. | ACCEL. WT. (LBS.) | APP. ANGLE (DEG.) | ENGINE RPM AT IMPACT | VELOCITY IN./SEC. AT IMPACT | LINEAR REACTION LIFT HT. (IN.) | LINEAR REACTION NET ENERGY (IN./LB.) | ROTARY REACTION KICK. ANGLE (DEG.) | ROTARY REACTION NEG. FORCE (LBS.) | ROTARY REACTION NET ENERGY (IN./LBS.) | TOTAL NET ENERGY (IN./LB.) |
|---|---|---|---|---|---|---|---|---|---|---|
| 5 | 4 | 0 | +200 9000 | 28 | 0 | 0 | 159 | 6 | 48.9 | 48.9 |
| 6 | 4 | 0 | +200 9000 | 28 | 0 | 0 | 161 | 6 | 49.5 | 49.5 |
| 7 | 2 | −10 | +200 9000 | 19 | $\frac{1}{8}$ | .3 | 134 | 6 | 41.2 | 41.5 |
| 8 | 2 | −10 | +200 9000 | 19 | $\frac{1}{8}$ | .3 | 136 | 6 | 41.8 | 42.1 |
| 9 | 2 | −10 | +200 9000 | 19 | $\frac{1}{8}$ | .3 | 164 | 6 | 50.5 | 50.8 |
| 10 | 4 | −10 | +200 9000 | 29 | 0 | 0 | 225 | 6 | 69.2 | 69.2 |
| 11 | 4 | −10 | +200 9000 | 29 | 0 | 0 | 219 | 6 | 67.4 | 67.4 |
| 12 | 4 | −10 | +200 9000 | 29 | 0 | 0 | 205 | 6 | 63.1 | 63.1 |
| 13 | 2 | −20 | +200 9000 | 18 | $4\frac{1}{8}$ | 0 | 106 | 6 | LOOSE INSOLATOR | |
| 14 | 2 | −20 | +200 9000 | 18 | $4\frac{1}{4}$ | 0 | 100 | 6 | LOOSE INSOLATOR | |
| 15 | 2 | −20 | +200 9000 | 18 | $1\frac{1}{4}$ | 2.5 | 10 | 6 | 3.1 | 5.6 |
| 16 | 2 | −20 | +200 9000 | 18 | $1\frac{1}{4}$ | 2.5 | 6 | 6 | 1.8 | 4.3 |
| 17 | 2 | −20 | +200 9000 | 18 | $\frac{1}{2}$ | 1.0 | 2 | 6 | .62 | 1.62 |
| 18 | 4 | −20 | +200 9000 | 28 | $1\frac{3}{8}$ | 5.5 | 210 | 6 | 64.6 | 70.1 |
| 19 | 4 | −20 | +200 9000 | 28 | $3\frac{1}{4}$ | 13.0 | 80 | 6 | 24.6 | 37.6 |
| 20 | 4 | −20 | +200 9000 | 28 | $3\frac{3}{8}$ | 13.5 | 246 | 6 | 75.7 | 89.2 |
| 21 | 2 | −30 | +200 9000 | 18 | 0 | 0 | 0 | 6 | — | — |
| 22 | 2 | −30 | +200 9000 | 18 | 0 | 0 | 2 | 6 | .62 | .62 |
| 23 | 2 | −30 | +200 9000 | 18 | 0 | 0 | 0 | 6 | — | — |
| 24 | 4 | −30 | +200 9000 | 28 | 0 | 0 | 2 | 6 | .62 | .62 |
| 25 | 4 | −30 | +200 9000 | 28 | 0 | 0 | 4 | 6 | 1.2 | 1.2 |
| 26 | 4 | −30 | +200 9000 | 29 | 0 | 0 | 3 | 6 | .92 | .92 |

Following the tests the results shown in Tables I and II were analysed and summerized in Tables III and IV below.

TABLE III

| APP. ANGLE | WOOD GRAIN | Example 1 AVERAGE NET ROTARY IN. LBS. | Example 1 DEVIATION | Example 1 AVERAGE TOTAL NET IN. LBS. | Example 1 DEVIATION | Example 2 AVERAGE NET ROTARY IN. LBS. | Example 2 DEVIATION | Example 2 AVERAGE TOTAL NET IN. LBS. | Example 2 DEVIATION |
|---|---|---|---|---|---|---|---|---|---|
| 0 | E | 36.3 | 3.4 | 36.3 | 3.4 | 23.1 | 1.3 | 23.1 | 1.3 |
| −10 | | 86.7 | 3.7 | 89.3 | 3.2 | 44.5 | 5.2 | 44.8 | 5.2 |
| −20 | | 99.1 | 15.7 | 119.1 | 15.7 | 1.8 | 1.2 | 3.8 | 2 |
| −30 | | 0 | 0 | 0 | 0 | .3 | .4 | .3 | .4 |

TABLE IV

| APP. ANGLE | WOOD GRAIN | Example 1 AVERAGE NET ROTARY IN. LBS. | Example 1 DEVIATION | Example 1 AVERAGE TOTAL NET IN. LBS. | Example 1 DEVIATION | Example 2 AVERAGE NET ROTARY IN. LBS. | Example 2 DEVIATION | Example 2 AVERAGE TOTAL NET IN. LBS. | Example 2 DEVIATION |
|---|---|---|---|---|---|---|---|---|---|
| 0 | E | 57.2 | 14.5 | 57.2 | 14.5 | | | | |

TABLE IV-continued

| | | Example 1 | | | | Example 2 | | | |
|---|---|---|---|---|---|---|---|---|---|
| APP. ANGLE | WOOD GRAIN | AVERAGE NET ROTARY IN. LBS. | DEVIA-TION | AVERAGE TOTAL NET IN. LBS. | DEVIA-TION | AVERAGE NET ROTARY IN. LBS. | DEVIA-TION | AVERAGE TOTAL NET IN. LBS. | DEVIA-TION |
| −10 | | 109.4 | 3.0 | 112.4 | 2.2 | 48.7 | .92 | 48.7 | .92 |
| −20 | | 87.6 | 12.4 | 112.4 | 11 | 66.6 | 3.1 | 66.6 | 3.1 |
| −30 | | 2.2 | .98 | 7.7 | 2.4 | 55 | 26.9 | 65.6 | 26.1 |
| | | | | | | .91 | .29 | .91 | .29 |

Table III summarizes the results at an approach velocity of about 18 2 in/sec and Table IV summarizes the results at an approach velocity of 28 2 in/sec. In each case the average net rotary and total reaction energy in pounds is shown, together with the standard deviation. The reduction kin kickback energy in the case of the bar and chain of Example 2 is considerable over most approach angles, and is most clearly seen graphically in FIGS. 6 and 7 which are graphical representations of the data presented in Tables III and IV respectively.

It will be appreciated that the considerably reduced kickback energy levels exhibited by the chain and bar of the present invention represents a considerable advance in safety of chain saws in that a major hazard has been considerably reduced.

I claim:

1. In a chain saw:

a saw chain guide bar;

a saw chain;

a drive sprocket; and lubrication means;

said guide bar being elongate and being symmetrically convexly curved about its longitudinal central axis and having a rounded nose and a pair of unitary peripheral rails;

said saw chain comprising a plurality of chain links in an endless repeating sequence of drive link, tie link, and a couple comprising cutter and balance link, with alternate cutter links being left- and right-hand;

each of said couple of cutter and balance links and each of said tie links having lower edges adapted to maintain continuous contact with the rails of said guide bar, the lower edges of said couple of cutter and balance links each having three curved surfaces, two of said curved surfaces lying on a first arc corresponding to the convex curve along the length of said guide bar, the other one of said three surfaces being centered between two said surfaces and lying on a second arc corresponding to the curve of the rounded nose of said guide bar; the lower edge of each of said tie links having a central curved surface lying on the second arc corresponding to the curve of the rounded nose of said guide bar;

the cutter links of each couple having a height to length ratio no greater than 1:2;

said drive sprocket having teeth the ends of which each have a radius of curvature equal to the radius of curvature of said rounded nose of said guide bar;

said radius of curvature of said guide bar nose being proportional to said chain links such that no more than one cutter link is at any time within an arc of 70° of the longitudinal central axis of the guide bar;

said guide bar having a groove between said rails equal in depth of the portion of the drive link in said groove;

said lubricating means including a passageway in said guide bar communicating at one end with an oil supply and entering at its other end in said guide bar groove, said passageway being angled in the direction of chain movement within said groove.

2. The apparatus according to claim 1 wherein said guide bar groove includes a layer of a metal-filled epoxy resin along at least its bottom whereby as said guide bar rails and/or said chain link wear, said drive links having botoms which will abrade the epoxy resin so as to maintain zero clearance between the drive link bottoms and the guide bar groove.

3. The apparatus according to claim 2 wherein said metal is aluminum.

4. The apparatus according to claim 1, wherein the symmetrical convex curves along the longitudinal axis of the guide bar are continuous segments of a circle.

5. The apparatus according to claim 1 wherein the length of said second arc on the lower edges of each cutter link is equal in length to the distance between the centers of the rivet holes in said cutter link.

6. The apparatus according to claim 1 wherein the opening of said oil passageway into said guide bar groove has a diameter equal to the width of the groove.

7. The apparatus according to claim 1 wherein the angle of said oil passageway being between 90° and 45° to the longitudinal axis of said bar.

8. The apparatus according to claim 1 wherein said cutter links have a height:length ratio no less than 1:1.5.

* * * * *